US009857734B2

(12) United States Patent
Sakashita et al.

(10) Patent No.: US 9,857,734 B2
(45) Date of Patent: Jan. 2, 2018

(54) IMAGE FORMING APPARATUS

(71) Applicants: Takeshi Sakashita, Tokyo (JP); Kenji Nakamura, Kanagawa (JP); Masanari Fujita, Tokyo (JP); Yuuji Meguro, Kanagawa (JP); Takahiro Seki, Hyogo (JP); Naoki Takai, Tokyo (JP); Takuya Akiyama, Kanagawa (JP)

(72) Inventors: Takeshi Sakashita, Tokyo (JP); Kenji Nakamura, Kanagawa (JP); Masanari Fujita, Tokyo (JP); Yuuji Meguro, Kanagawa (JP); Takahiro Seki, Hyogo (JP); Naoki Takai, Tokyo (JP); Takuya Akiyama, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/340,583

(22) Filed: Nov. 1, 2016

(65) Prior Publication Data

US 2017/0139353 A1 May 18, 2017

(30) Foreign Application Priority Data

Nov. 12, 2015 (JP) ..... 2015-222076

(51) Int. Cl.
*G03G 15/08* (2006.01)
*G03G 15/16* (2006.01)
*G03G 21/00* (2006.01)

(52) U.S. Cl.
CPC ..... *G03G 15/161* (2013.01); *G03G 21/0064* (2013.01); *G03G 2221/1627* (2013.01)

(58) Field of Classification Search
CPC ..... G03G 15/161; G03G 21/0064; G03G 2221/1627
See application file for complete search history.

(56) References Cited

U.S. PATENT DOCUMENTS

2008/0101819 A1* 5/2008 Nakamura ..... G03G 15/025 399/176
2011/0058831 A1 3/2011 Usami et al.
2012/0008970 A1* 1/2012 Takenaka ..... G03G 15/0131 399/66

(Continued)

FOREIGN PATENT DOCUMENTS

JP 2007-233049 9/2007
JP 2009-053396 3/2009

(Continued)

*Primary Examiner* — Ryan Walsh
(74) *Attorney, Agent, or Firm* — Oblon, McClelland, Maier & Neustadt, L.L.P.

(57) ABSTRACT

An image forming apparatus includes a plurality of image bearers, a plurality of developing devices, a plurality of first transfer devices disposed opposite the plurality of image bearers, a second transfer device, a cleaning device to remove toner remaining on the intermediate transferor after a secondary transfer process, and a processor to control the plurality of developing devices to perform a refresh process to discharge toner from the plurality of developing devices to the plurality of image bearers. Among toner of the colors, toner having a first circularity first reaches the cleaning device and toner having a second circularity higher than the first circularity subsequently reaches the cleaning device in the refresh process.

13 Claims, 5 Drawing Sheets

(56) References Cited

U.S. PATENT DOCUMENTS

2015/0117901 A1 4/2015 Kichise et al.

FOREIGN PATENT DOCUMENTS

| | | |
|---|---|---|
| JP | 2009-092903 | 4/2009 |
| JP | 2010-026197 | 2/2010 |
| JP | 2012-008367 | 1/2012 |
| JP | 2015-022231 | 2/2015 |

* cited by examiner

IMAGE FORMING APPARATUS

CROSS-REFERENCE TO RELATED APPLICATION

This patent application is based on and claims priority pursuant to 35 U.S.C. §119(a) to Japanese Patent Application No. 2015-222076, filed on Nov. 12, 2015, in the Japan Patent Office, the entire disclosure of which is hereby incorporated by reference herein.

BACKGROUND

Technical Field

Aspects of the present disclosure generally relate to an image forming apparatus, such as an electrophotographic copier, a printer, a facsimile machine, and a multifunction peripheral (MFP).

Related Art

In an electrophotographic image forming apparatus, a cleaning blade removes residual toner from an intermediate transfer belt to clean the intermediate transfer belt. With an increase in degree of circularity of toner, high-resolution and high-quality images are achieved. However, removing toner of high circularity with the cleaning blade is difficult.

In an electrophotographic image forming apparatus that is capable of outputting color images, toner employed for plural colors, such as yellow, magenta, cyan, and black, differs in degree of circularity between the colors.

In this case, the degree of circularity is equal to a ratio of a perimeter of a circle having the same area as a projected area of toner particles relative to a perimeter of a projected image of toner particles.

When the electrophotographic image forming apparatus repeatedly forms images, toner within a developing device is less likely to be replaced with new toner with a lower printing ratio that is a ratio of an area to be printed relative to an area of a transfer sheet which allows an image to be formed because a less amount of toner is moved from a developing roller to a photoconductor, to be developed into a toner image. As a result, the toner remains within the developing device for a longer time. The toner remaining within the developing device for a long time is stirred and applied with stress for a long time, thereby degrading the charging capability and charge retaining capability, resulting in a deterioration in quality of images due to cleaning failure. When toner is maintained charged for a long time, the toner accumulates within the developing device due to stress by the friction and pressure of the developing blade and the developing roller. Such toner remaining within the developing device for a long time is referred to as "degraded toner".

To prevent a deterioration in quality of images due to degraded toner adhering to the developing roller within the developing device, a "refresh" process is performed to replace toner stored within the developing device with new fresh toner, that is, refresh toner. Specifically, an average printing area ratio and the distance of rotation of a toner supply roller are employed such that old toner is discharged from the interior of the developing device to the photoconductor at a predetermined timing and a toner pattern is formed between transfer sheets on the intermediate transfer belt. Then, new toner is resupplied to the developing device, thus preventing degraded toner from remaining within the developing device for a long time. Such a manner to "refresh" toner within the developing device improves the image quality.

To improve the cleanability of a photoconductor cleaner, a forced discharge process for discharging toner from a developing roller, i.e., the refresh process, is performed in which toner of irregular shapes to be successfully removed by the photoconductor cleaner is forced to enter the photoconductor cleaner and toner of a spherical shape to be unsuccessfully removed by the photoconductor cleaner is forced to reach a belt cleaner. Alternatively, a mass of toner with a constant ratio between an irregular shaped toner and a spherical toner is input to each of the belt cleaner and the photoconductor cleaner, thereby improving the cleanability of the cleaners. However, even with changes in a mixture ratio of the irregular shaped toner and the spherical toner, when the spherical toner first reaches the belt cleaner or the photoconductor cleaner, a cleaning failure may occur.

SUMMARY

In an aspect of this disclosure, there is provided an image foil ling apparatus including a plurality of image bearers to bear electrostatic latent images; a plurality of developing devices disposed opposite the plurality of image bearers, to develop the electrostatic latent images borne on the plurality of image bearers into toner images of colors; a plurality of first transfer devices disposed opposite the plurality of image bearers, to primarily transfer the toner images from the plurality of image bearers to an intermediate transferor with a primary transfer bias; a second transfer device to secondarily transfer the toner images from the intermediate transferor to a recording medium with a secondary transfer bias; a cleaning device to remove toner remaining on the intermediate transferor after a secondary transfer process; and a processor to control the plurality of developing devices to perform a refresh process to discharge toner from the plurality of developing devices to the plurality of image bearers. Among toner of the colors, toner having a first circularity first reaches the cleaning device and toner having a second circularity higher than the first circularity subsequently reaches the cleaning device in the refresh process.

BRIEF DESCRIPTION OF THE DRAWINGS

The aforementioned and other aspects, features, and advantages of the present disclosure will be better understood by reference to the following detailed description when considered in connection with the accompanying drawings, wherein.

Figure 1:
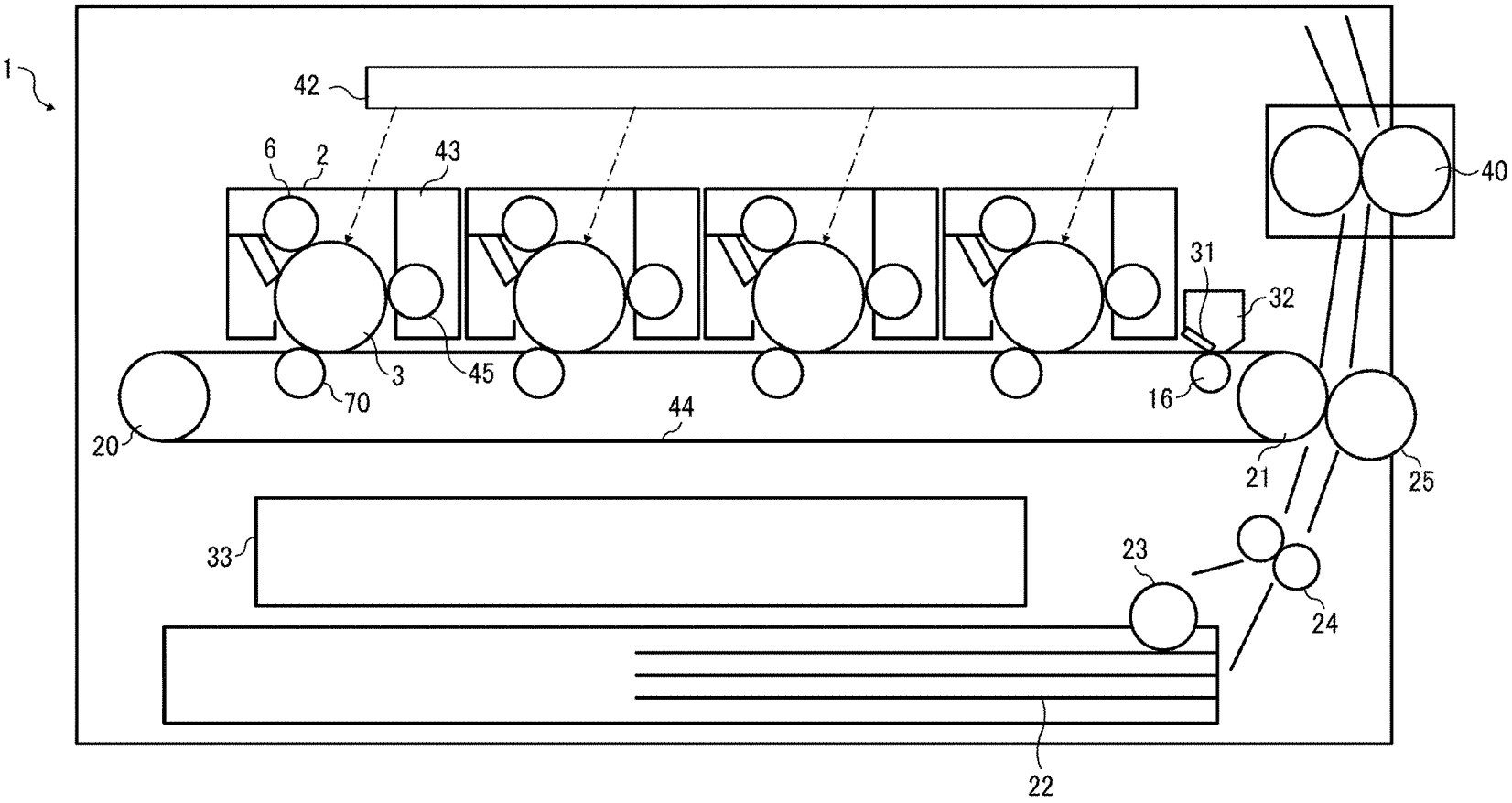
FIG. 1 is a schematic illustration of an image forming apparatus according to an embodiment of the present disclosure.
Figure 2:
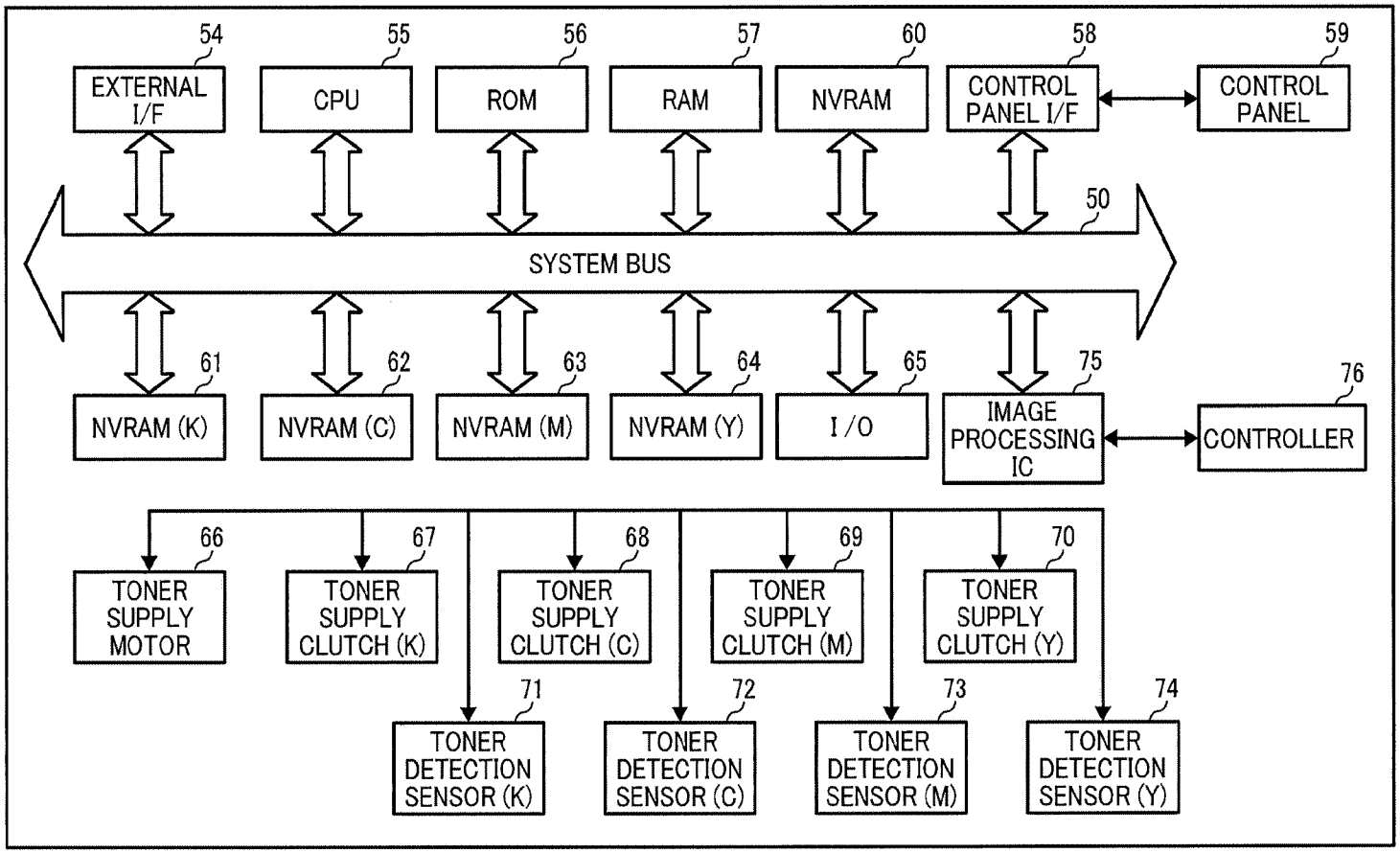
FIG. 2 is a block diagram of a control system of the image forming apparatus 1 according to an embodiment of the present disclosure.

The accompanying drawings are intended to depict embodiments of the present disclosure and should not be interpreted to limit the scope thereof The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

A description is provided of a configuration and operation of an electrophotographic device (hereinafter, referred to as an image forming apparatus 1) according to an embodiment of the present disclosure below.

FIG. 1 is a cross-sectional view of a multicolor image forming apparatus 1 according to an embodiment of the present disclosure.

Within the image forming apparatus 1 according to the present embodiment of this disclosure, a photoconductor drum 3 as an image bearer which is tubular with a diameter of 30 mm is disposed. The photoconductor drum 3 rotates at a peripheral speed ranging from 50 mm/s through 200 mm/s. A charger 6 formed in a roller shape pressingly contacts the surface of the photoconductor drum 3. The charger 6 rotates with the photoconductor drum 3, receiving a bias of a direct current (DC) voltage or a bias, in which the DC voltage is superimposed on an alternating current (AC) voltage, from a high-voltage power source disposed within the image forming apparatus 1. Accordingly, the surface of the photoconductor drum 3 is uniformly charged to have a potential of −500 V.

The photoconductor drum 3 bearing a latent image as image data is exposed by an exposure device 42 as a latent image writer to form an electrostatic latent image. The exposure device 42 employs a laser beam scanner with a laser diode or a light emitting diode (LED) to perform such an exposure process. In the present embodiments, with the surface of the photoconductor drum 3 subjected to exposure, the surface potential drops down to −50 V.

A developing device 43 is a one-component-contact developing device. The developing device 43 develops an electrostatic latent image of the photoconductor drum 3 with a bias of a predetermined value, such as −200 V, supplied from the high-voltage power source, into a visualized toner image. Specifically, the developing device 43 includes a developing roller 45. Thus, toner 53 is discharged from the developing roller 45 onto the photoconductor drum 3 and thereby an electrostatic latent image on the photoconductor drum 3 is developed into a toner image. The developing device 43 stores one-component toner having a negative charging polarity.

The photoconductor drum 3, charger 6, and the developing device 43 are integrated into a process unit 2.

In the image forming apparatus 1 according to the present embodiments, four process units 2 for colors, yellow, magenta, cyan, and black, are disposed in parallel. That is, the image forming apparatus 1 according to the present embodiment includes four photoconductor drums 3, chargers 6, and the developing devices 43 for the respective colors. When forming a full-color image, the image forming apparatus 1 forms visible images for black, yellow, magenta, and cyan in this recited order, but not limited to this order. Accordingly, the visible images in different colors are transferred onto a transfer belt 44 as an intermediate transferor contacting the photoconductor drum 3 such that the visible images are superimposed one atop the other, thereby forming a full-color toner image on the transfer belt 44.

During the formation of a full-color toner image, increasing the degree of circularity of toner 53 achieves a high-resolution and high-quality image. However, removing toner 53*a* having a higher circularity with a cleaning blade 31 is difficult. In an electrophotographic image forming apparatus that is capable of outputting color images, employed toner of plural colors, such as yellow, magenta, cyan, and black, differs in degree of circularity between the colors. This is because pigment of the polymerization toner of each color has a different dispersibility when dispersed in the base. That is, when pigment evenly disperses in the base, the resultant toner has a higher circularity. By contrast, pigment unevenly disperses in the base, the resultant toner has a lower circularity. Accordingly, increasing the circularity of toner containing pigment with a lower dispersibility is difficult and reducing the circularity of toner 53 containing pigment with a higher dispersibility is difficult as well. In such a manner, toner 53 for each color has a different circularity.

The transfer belt 44 is entrained about and stretched taut between a secondary-transfer first roller 21 as a transfer driver, a cleaning opposed roller 16, a primary-transfer roller 91, and tension roller 20. The transfer belt 44 is driven to rotate by a drive motor within the image forming apparatus 1 via the secondary-transfer first roller 21. The drive sources for the process unit 2 and the secondary-transfer first roller 21 may be disposed independently of each other. Alternatively, the common drive source may be disposed for the process unit 2 and the secondary-transfer first roller 21. At least the process unit 2 for black and the secondary-transfer first roller 21 (transfer driver) are typically turned on and off at the same time. In this case, a common power source is preferably used to achieve a reduction in size and cost. The tension roller 20 as a tension device for the transfer belt 44 is pressed by a spring at either sides of the tension roller 20.

A cleaning unit 32 is disposed around and downstream of the secondary-transfer first roller 21 in the direction of movement of belt. The cleaning unit 32 includes a cleaning blade 31 as a cleaning device contacting the surface of the transfer belt 44 to scrapes off untransferred residual toner from the surface of the transfer belt 44, thus cleaning the transfer belt 44. Instead of such a blade cleaning method, an electrostatic brush method or an electrostatic roller method may be adopted. In such a case, a cleaning brush or roller is disposed instead of the cleaning blade 31. With the electrostatic method, there are some cases in which a backup charge for the untransferred residual toner is used according to the status of use of the image forming apparatus 1. In such cases, the cleaning unit 32 itself increases in size, and one to two high-voltage power sources are added so that an extra operation for bias cleaning is performed. Accordingly, the blade cleaning method is preferably employed from the viewpoints of reduction in size and cost as well as cleanability.

The untransferred residual toner scraped off by the cleaning blade 31 is then transported to and stored in a waste toner container 33 dedicated for the transfer belt 44, through a waste-toner conveyance path within the image forming apparatus 1.

The primary-transfer roller 91 is a sponge roller or a metal roller with a diameter ranging from 12 through 16 mm, opposed to the photoconductor drum 3 via the intermediate transfer belt 44. The primary-transfer roller 91 as a primary transfer device receives a primary transfer bias ranging from +100 V through +2000 V from a dedicated high-voltage power source within the image forming apparatus 1 to primarily transfer a toner image from the photoconductor drum 3 onto the transfer belt 44. The primary-transfer roller 91, which is a sponge roller, is an ion conductive roller (combination of urethane and carbon dispersion, ntrile-butadene rbber (NBR), epichlorhydrin rubber) or an electronically conductive roller (Ethylene Propylene Rubber (EPDM)) having a resistance value ranging from $10^6$ through $10^8$ Ω.

As the materials for the intermediate transfer belt 44, an endless belt of a resin film is employed, in which conductive material, such as carbon black, is dispersed in poly vinyldene fluoride (PVDF), ethylenetetrafluoroethylene (ETFE), polyimide (PI), polycarbonate (PC), and thermoplastic elastomer (TPE). In the present embodiment, a single-layer belt having a thickness ranging from 90 through 160 μm and a width of 230 mm is used, in which carbon black is added to the TPE with a tensile elasticity ranging from 1000 through 2000 MPa. The volume resistivity of the belt ranges from $10^8$ through $10^{11}$ Ωcm and the surface resistivity of the belt ranges from $10^8$ through $10^{11}$ Ω/sq at a temperature of 23° C. and a relative humidity (RH) of 50%, which are measured with an applied voltage of 500V for 10 seconds, Hiresta UPMCPHT 45 manufactured by Mitsubishi Chemical Corporation.

The secondary-transfer second roller 25 is a sponge roller having a diameter of 16 through 25 mm. Example of the secondary-transfer second roller 25 is an ion conductive roller (combination of urethane and carbon dispersion, ntrile-butadene rbber (NBR), epichlorhydrin rubber) or an electronically conductive roller (Ethylene Propylene Rubber (EPDM)) having a resistance value ranging from $10^6$ through $10^8$ Ω. The resistance value of the secondary-transfer second roller 25 exceeding the upper limit described above makes it difficult for a sufficient amount of current to flow. Accordingly, a high voltage is applied to achieve a successful transfer, resulting in an increase in cost for power source. In addition, applying a high voltage to a transfer nip leads to the occurrence of electrical discharge in space in the vicinity of the transfer nip, thereby causing white spots to appear in a halftone image. Such a phenomenon is prominent under the environment conditions of low temperature and low humidity, for example at a temperature of 10° C. and a relative humidity (RH) of 15%. By contrast, the resistance value of the secondary-transfer second roller 25 falling below the lower limit described above hampers the transferability of both an image portion including a plurality of colors (hereinafter referred to as multi-color image portion) in an image, e.g., a three-color composite image, and a single-color image portion. This is because, a relatively low voltage is sufficient to perform a transfer in a single-color image portion with a sufficient amount of current flow. By contrast, to perform a successful transfer in a multi-color image portion, a higher voltage is applied than an appropriate amount of voltage for the single-color image portion. Accordingly, with an amount voltage appropriate for the multi-color image applied, an excessive amount of transfer current is applied to the single-color image portion, thus reducing the transfer efficiency.

It is to be noted that, the resistance value of each of the primary-transfer roller 91 and the secondary-transfer second roller 25 is calculated from the value of current flown when a voltage of 1 kV is applied to between the metal core of each roller and a conductive metal plate, on which each roller is disposed. In this case, each core metal has a load of 4.9 N on both ends of the core metal.

The secondary-transfer first roller 21 as a drive roller may be made of polyurethane rubber with a thickness ranging from 0.3 through 1 mm, or may be a thin coated roller with a thickness ranging from 0.03 through 0.1 mm. In the present embodiment, the secondary-transfer first roller 21 is a urethane coated roller with a thickness of 0.05 mm and a diameter of 19 mm, which has a small change in diameter with changes in temperature. The electrical resistance value of the secondary-transfer first roller 21 is set less than $10^6$ Ω, which is lower than the resistance value of the secondary-transfer second roller 25.

A stack of transfer sheets are stored in a cassette 22. The transfer sheet is fed by a sheet conveyance roller 23 and a registration roller pair 24 in an appropriate timing at which the leading edge of the toner image on the surface of the transfer belt 44 arrives at a secondary transfer position. When the high-voltage power source applies a predetermined amount of the secondary transfer bias to a portion between the secondary-transfer first roller 21 and the secondary-transfer second roller 25 and thereby the toner image is secondarily transferred from the transfer belt 44 onto the transfer sheet. In the present embodiment of this disclosure, the transfer sheets are conveyed through a vertical conveyance path. The curvature of the secondary-transfer first roller 21, around which the transfer belt 44 is looped, enables the transfer sheet to separate from the transfer belt 44. The transfer sheet after separated from the transfer belt 44 enters a fixing device 40 to fix the toner image transferred onto the transfer sheet and the transfer sheet having exited the fixing device 40 is discharged from a discharge port. The fixing device 40 includes a fixing roller and an opposed roller opposed to the fixing roller. The fixing roller includes a heater, such as a halogen heater. Under heat and pressure of the fixing roller and the opposed roller, the toner image is fixed to the transfer sheet passing through a fixing nip between the fixing roller and the opposed roller.

There are two secondary transfer methods: One is an attraction transfer method, in which a bias having a positive polarity is applied to the secondary-transfer second roller 25 and the secondary-transfer first roller 21 is electrically grounded to form a secondary transfer electrical field. The other is a repulsive force transfer method, in which a bias having a negative polarity is applied to the secondary-transfer first roller 21 and the secondary-transfer second roller 25 is electrically grounded to form a secondary transfer electrical field. In the present embodiment, the repulsive force transfer method is employed, in which a secondary transfer bias ranging from +5 through 100 μA is applied under a constant current control when a recording sheet P passes through a nip.

In the present embodiment, a speed of image formation process changes according to the type of the recording medium P. Particularly, with the recording medium P having a sheet basis weight of greater than 100 g/m$^2$, the image formation process slows down to a half speed. Accordingly, the recording media P passes through a fixing nip formed by a fixing roller pair in the fixing device 60, taking twice time longer than the normal speed of the image formation process, thereby ensuring the fixing property of a toner image.

Next, a description is provided of a processing block of the image forming apparatus 1.

FIG. 1 is a block diagram of a control system of the image forming apparatus 1 according to an embodiment of the present disclosure.

A central processing unit (CPU) 55 as a processor of the image forming apparatus 1 controls access to various devices connected with a system bus 50 according to control programs stored in a read only memory (ROM) 56. The CPU 55 also controls input and output of electrical components, such as a sensor, a motor, a clutch, and a heater, which are connected to each other via an input/output (I/O) 65.

The ROM 56 stores the control programs. The CPU 55 executes the control programs stored in the ROM 56 and performs the communication processing with an external device, such as a host computer, via an external interface (I/F) 54.

A random access memory (RAM) 57 functions as a main memory and a work area of the CPU 55. The RAM 57 is used as an expanding area and environment data storage area.

A non-volatile random access memory (NVRAM) 60 stores data regarding an image foaming apparatus 1 that uses the control program.

The NVRAMs 61, 62, 63, and 64 are mounted on the respective toner containers for black, cyan, magenta, and yellow, respectively. Each of the NVRAMs 61, 62, 63, and 64 stores data regarding the remaining quantity of toner in each toner container.

A control panel 59 connected to a system bus 50 via a control panel interface (I/F) 58 allows the setting of a printer mode.

A toner supply motor 66 is driven to set each of the toner supply clutches 67, 68, 69, and 70 ON, and toner is supplied from the toner containers for the respective colors to the developing device 43.

Within each developing device 43 is disposed a toner detection sensor 71, 72, 73, and 74 to detect toner.

An image processing integrated circuit (IC) 75 receives image data from a controller 76 and sends image data to an optical writing device disposed on the upper part of the apparatus. Moreover, the image processing IC 75 serves to calculate the amount of toner consumption per page and notifies the CPU 55 of the calculated amount of toner consumption via the system bus 50.

Figure 3:
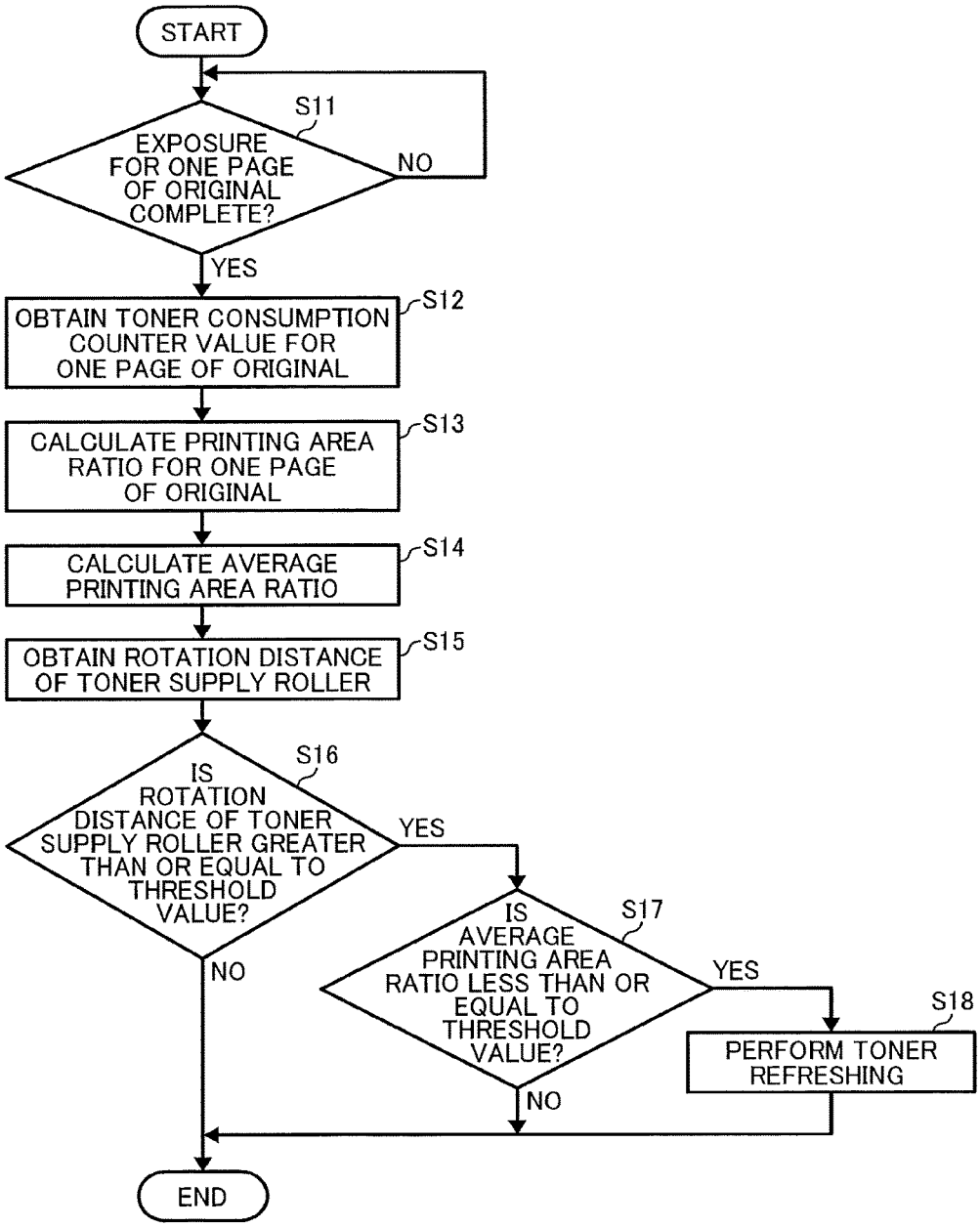
FIG. 3 is a flowchart of the procedure for performing a refresh process of the image forming apparatus of FIG. 1.

Next, a descriptions is provided of the procedure for the refresh process (refresh mode execution procedure), referring to the flowchart of FIG. 3.

FIG. 3 is a flowchart of the procedure for performing the refresh process. The CPU 55 obtains printing instructions for image data output from the controller 76 and sends the image data to the image processing IC 75 so that the optical writing device starts both an exposure process and the refresh process.

The CPU 55 judges whether the exposure process for one page of an original document is completed (step S11).

When making a negative judgment, the CPU 55 repeats step S11 and waits until the exposure process for one page of the original document is completed.

By contrast, when making an affirmative judgment, the CPU 55 obtains, from the image processing IC 75, the value of the toner consumption counter for one page of the original document (step S12).

Subsequently, the CPU 55 calculates the printing area ratio for one page of an original document with respect to each of the colors (cyan, magenta, yellow, and black) (step S13).

In this case, the printing area ratio T is obtained by dividing the value U of the toner consumption counter by the total pixel numbers within a printing area, that is, a value obtained by multiplying the number P of pixels along the width of a toner supply roller (developing roller 45) by the number Q of pixels along a sub-scanning direction of the toner supply roller.

That is, the printing area ratio T is equal to a ratio of the value U of the toner consumption counter relative to a value obtained by multiplying the number P of pixels along the width of the toner supply roller by the number Q of pixels along a sub-scanning direction of the toner supply roller.

Next, a description is provided of a calculation example of a printing area ratio of black toner.

For example, when the value U of the toner consumption counter for the black toner, which is obtained in step S12, is 3937379 dot, the width of the toner supply roller is 297 mm, and the pixel density along the main scanning direction (the width of the toner supply roller) is 1200 dpi, the number P of pixels along the width of the toner supply roller is 14031 dot which is obtained by dividing 297 by 25.4 and multiplying the divided value by 1200 ((297/25.4)×1200=14031). In this case, 1 inch is equal to 25.4 mm.

When the pixel density in the sub-scanning direction is 2400 dpi and the length of the original document in the sub-scanning direction is 297 mm, the number Q of pixels in the sub-scanning direction is 28062 dot which is obtained by multiplying 2400 by a value obtained by dividing 297 by 25.4 ((297/25.4)×2400=28062 dot). As a result, the printing area ratio T is approximately 1% calculated by dividing 3937379 by a value obtained by multiplying 14031 by 28062 (3937379/(14031×28062)).

Subsequently, the CPU 55 calculates an average printing area ratio (step S14). Here, the average printing area ratio refers to an average value of the printing area ratio after a previous refresh process is performed. The average printing area ratio until the previous page and the number of pages are stored for each color in the NVRAM 60.

Accordingly, the CPU 55 obtains, from the NVRAM 60, the average value of the printing area ratio until the previous page and the number of pages and calculates a new average printing area ratio based on the obtained average value and a newly calculated printing area ratio T. The newly calculated average printing area ratio is stored in the NVRAM 60 and thus the stored average printing area ratio is updated.

Subsequently, the CPU 55 obtains the distance of rotation of the toner supply roller (step S15). The distance of rotation of the toner supply roller since after the previous refresh process is performed is stored in the NVRAM 60. Subsequently, the CPU 55 obtains the distance of rotation of the toner supply roller from the NVRAM 60.

Next, the CPU 55 judges whether the distance of rotation of the toner supply roller is greater than or equal to a threshold value (step S16). In the present embodiment, the threshold value, which is preliminarily stored in the NVRAM 60, is set 200 m, for example. The threshold value is changed by a user's operation via the control panel 59.

When making a negative judgment (No for step S16), the CPU 55 completes the procedure for performing the refresh process without performing the refresh process.

When making an affirmative judgment (Yes for step S16), the CPU 55 judges whether the average printing area ratio calculated in step S14 is less than or equal to a threshold value (step S17). In the present embodiment, the threshold value, which is preliminarily stored in the NVRAM 60, is set, e.g., 3%. With such a threshold value, fewer numbers of the refresh processes is executed, thereby reducing the amount of toner consumption. The threshold value may be changed by a user's operation via the control panel 59.

When making a negative judgment (No for step S17), i.e., the average printing area ratio is high, the CPU 55 completes the procedure for performing the refresh process without performing the refresh process.

When making a negative judgment (Yes for step S17), i.e., the average printing area ratio is low, the CPU 55 performs the refresh process to force toner adhering to the developing roller 45 to be consumed (step S18). As described above, only with the printing area ratio of less than or equal to the threshold value, the refresh process is performed. Such a configuration reduces the number of refresh processes, thereby reducing the amount of toner consumption. Subsequently, the CPU 55 sets the distance of rotation of the toner supply roller and the average printing area ratio stored in the NVRAM 60 to be "zero" to reset the stored distance and average ratio before completing the refresh process.

With such a refresh process performed, old toner is discharged from the developing device 43 to the photoconductor drum 3 at a predetermined timing and a toner pattern is formed between transfer sheets on the transfer belt 44, to prevent degraded toner from remaining within the developing device 43. That is, the refresh process causes toner in the interior of the developing device 43 to adhere onto the photoconductor 3 at a predetermined timing. Thus, image quality improves. The formed toner pattern is collected by the cleaning unit 32 and new toner is supplied to the developing device 43. However, during the refresh process in step S18, toner 53 is discharged to the cleaning blade 31 such that toner 53*b* having a lower circularity (first circularity) among toner 53 for the respective colors first reaches the cleaning blade 31 in advance of toner 53*a* having a circularity (a second circularity) higher than the first circularity and the toner 53*a* having the second circularity subsequently reaches the cleaning blade 31. A specific example of the order of discharge of toner 53 will be described later.

Note that in the above-described example, the average printing area ratio of black toner is 1% and the threshold value of the average printing area ratio is 3%. In such a case, the refresh process is not performed. However, even when the toner 53*b* having the first circularity (lower circularity), e.g., yellow toner, has an average printing area ratio of greater than or equal to the threshold value and the refresh process is not to be performed, toner 53*a* having the second circularity (higher than the first circularity), i.e., black toner, has an average printing area ratio of less than or equal to the threshold value and the refresh process is to be performed. In such a case, a refresh process is performed for the toner 53*b* having the first circularity before another refresh process is performed for the toner 53*a* having the second circularity, irrespective of the degree of printing area ratio of toner 53*b* having the first circularity. By so doing, toner 53*b* having the first circularity is allowed to reliably reaches the cleaning blade 31 before toner 53*a* having the second circularity reaches the cleaning blade 31.

In such a case, the image forming apparatus 1 includes a temperature sensor as a temperature detection device or a temperature-and-humidity sensor to detect the temperature in the interior of the image forming apparatus 1. No refresh process for the toner 53*b* having the first circularity is performed according to the detected temperature. Under a high temperature and humidity, the cleaning blade 31 is more likely to vibrate, and thereby toner 53 easily escape from the cleaning blade 31. By contrast, under a low temperature and humidity, the cleaning blade 31 stiffens and thereby fails to deform and fit toner 53 and the transfer belt 44 opposed to the cleaning blade 31. Thus, toner 53 is more likely to escape from the cleaning blade 31. Under the temperature intermediate between the low temperature and the high temperature, a high cleanability is obtained. When the intermediate temperature is detected by the temperature sensor or the temperature-and-humidity sensor, no refresh process is performed for the toner 53*b* having the first circularity, thereby reducing an excess consumption of toner 53.

Note that a cleaning blade 31 resistant to a high temperature is vulnerable to a low temperature and a cleaning blade 31 resistant to a low temperature is vulnerable to a high temperature. In view of the above, when the image forming apparatus 1 is used in, e.g., a high-temperature region, a cleaning blade 31 resistant to a high temperature is employed and the refresh process is performed for the toner 53*b* having the first circularity only under a low temperature and humidity. By contrast, when the image forming apparatus 1 is used in, e.g., a low-temperature region, a cleaning blade 31 resistant to a low temperature is employed and the refresh process is performed for the toner 53*b* having the first circularity only under a high temperature and humidity.

A user may directly make instructions to perform the refresh process via the control panel 59 as an operating unit provided on the image forming apparatus 1 or via a personal computer (PC) connected to the image forming apparatus 1. In such a case, the refresh process is performed irrespective of the flow of the refresh process of FIG. 3. Such a configuration allows a user to perform the refresh process by the user's operation without waiting for a refresh process to be performed under control when a streak is formed on a transfer sheet due to a cleaning failure. As a result, the cleanability of cleaning blade 31.

Alternatively, in some embodiments, a user may switch between the presence and the absence of the refresh process via the control panel 59 as an operating unit provided on the image forming apparatus 1 or via a personal computer (PC) connected to the image forming apparatus 1. With such a configuration, the user switches to the absence operation of the refresh process when some streaks due to the cleaning failure are permissible for the user. Accordingly, an excess amount of toner consumption is eliminated or reduced.

The image forming apparatus 1 according to the present embodiment allows a user to change the interval between the transfer sheets on which an image is to be formed, so as to select a production mode (print per minute (PPM)) to set the number of transfer sheets to be printed per unit time. More specifically, the production mode includes a high-speed mode (high speed), an intermediate-speed mode (intermediate speed), and a low-speed mode (low speed). That is, in the image forming apparatus 1 according to the present embodiment, the CPU 55 executes the refresh process at the low-speed mode. Alternatively, a user selects the low-speed mode via the control panel 59 as an operation unit to execute the refresh process. Such a configuration allows the speed of toner reaching the cleaning blade 31 to decrease, thereby reliably removing toner 53 from the transfer belt 44.

Figure 4:
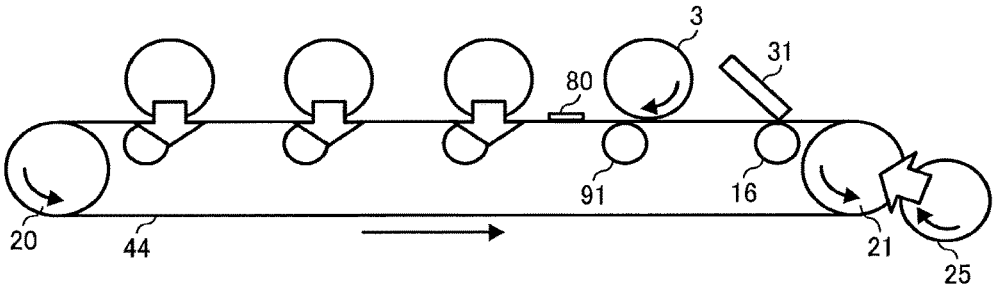
FIG. 4 is a schematic cross-sectional view of a transfer belt and parts surrounding the transfer belt according to an embodiment of the present disclosure.
Figure 5A:
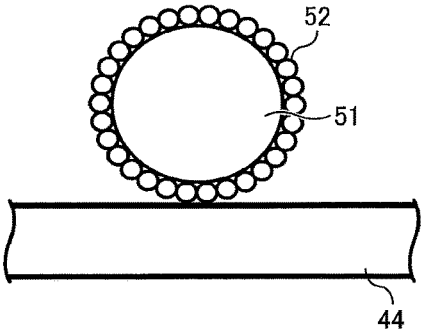
FIGS. 5A and 5B each is a schematic illustration of toner adhering to the transfer belt.

FIG. 4 is a schematic cross-sectional view of the transfer belt 44 and parts surrounding the transfer belt 44 according to the present embodiment. FIGS. 5A and 6B each is a schematic illustration of toner 53 adhering to the transfer belt 44.

As illustrated in FIG. 4, the cleaning blade 31, the photoconductor drum 3, and the secondary-transfer second roller 25 are disposed in the recited order along the direction of rotation of the transfer belt 44. As described above, when the image forming apparatus 1 repeatedly forms images, with a lower printing ratio that is a ratio of an area to be printed relative to an area of a transfer sheet which allows an image to be formed, toner 53 within a developing device 43 is less likely to be replaced with new toner because less amount of toner 53 is moved from a developing roller 45 to a photoconductor drum 3 to be developed into a toner image. As a result, the toner 53 remains within the developing device for a longer time. The toner 53 remaining within the developing device for a long time is stirred and stressed for a long time, and the external additive 52 (e.g., silica) of toner 53 comes off.

Figure 5B:
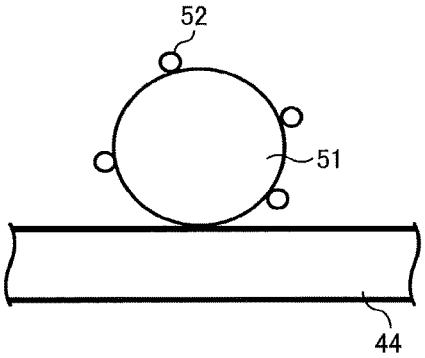

A toner particle 51 itself has viscosity and a high mechanical adhesive force. For such a reason, each toner particle 51 is typically covered with external additives 52 such as silica (refer to FIG. 5A). When toner 53 is stirred and stressed for a long time, the external additives 52 come off and the toner particle 51 is exposed to become degraded toner as illustrated in FIG. 5B. Accordingly, the mechanical adhesive force between the transfer belt 44 and the degraded toner increase, thereby making it difficult to scrape off the degraded toner by the cleaning blade 31, resulting in a significant deterioration in cleanability of the cleaning blade 31.

In order to avoid such situation, the average printing area ratio and the distance of rotation of the toner supply roller (developing roller 45) are used to form a toner pattern 80 between transfer sheets or at a position outside a transfer region on the transfer belt 44 as illustrated in FIG. 4, to discharge old toner from the interior of the developing device 43. However, toner 53 still deteriorates to some degree even after old (degraded toner) toner is discharged. A large amount of degraded toner reaches and enters a portion between the edge of the cleaning blade 31 and the transfer belt 44 at the time of discharging the degraded toner, resulting in a cleaning failure.

Figure 6A:
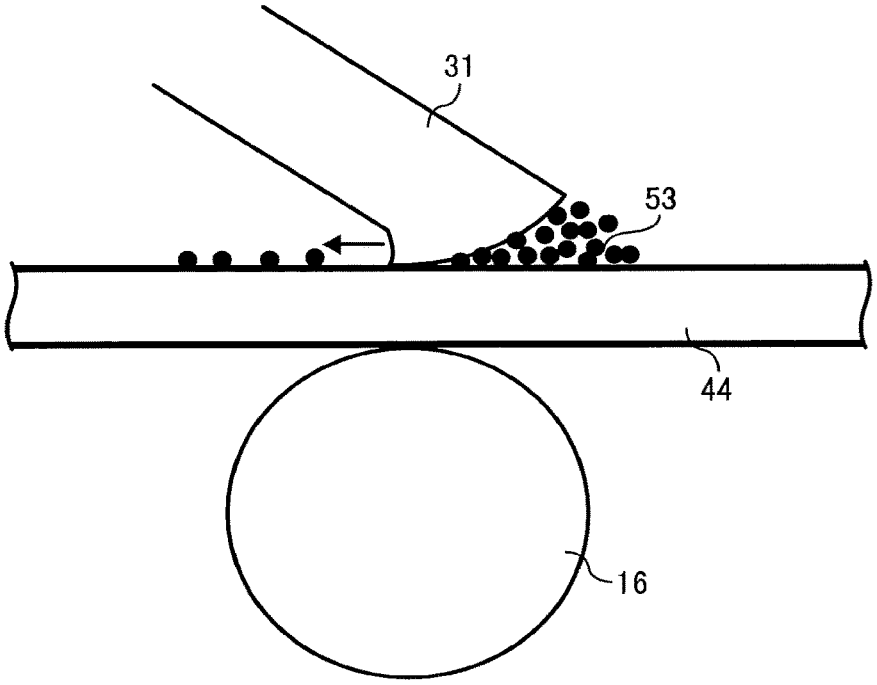
FIGS. 6A, 6B, and 6C each is a schematic illustration of toner at the edge of a cleaning blade according to an embodiment of the present invention.
Figure 6B:
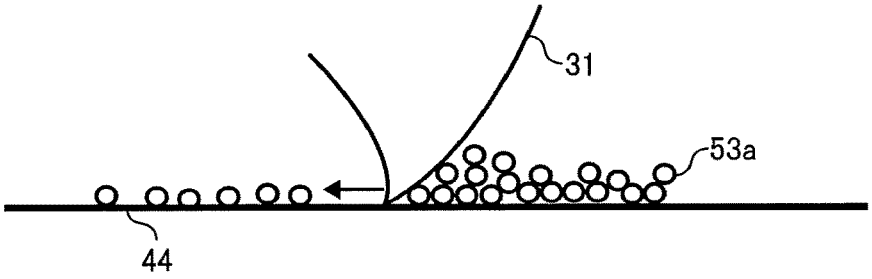
Figure 6C:
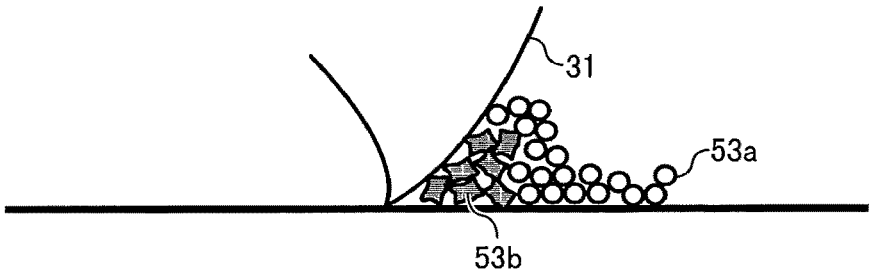

FIGS. 6A, 6B, and 6C each is a schematic illustration of toner 53 at the edge of the cleaning blade 31. FIG. 6A is an illustration of toner 53 escaping from the cleaning blade 31. FIG. 6B is an illustration of toner 53*a* with a higher circularity (second circularity) escaping from the cleaning blade 31. FIG. 6C is an illustration of toner 53*b* with a lower circularity (first circularity) than toner with the second circularity, collected by the cleaning blade 31.

As illustrated in FIG. 6A, the cleaning blade 31 is opposed to the cleaning opposed roller 16 across the transfer belt 44. Typically, all of the toner 53 is not scraped off by the cleaning blade 31 and a part of toner 53 escapes from the cleaning blade 31.

As illustrated in FIG. 6B, when the toner 53*a* having the second circularity reaches the cleaning blade 31, most of the toner 53*a* is scraped off by the cleaning blade 31 and a part of the toner 53*a* escapes from the cleaning blade 31. However, as illustrated in FIG. 6C, when the toner 53*b* having the first circularity reaches the cleaning blade 31 in advance of the toner 53*a* having the second circularity, the toner 53*b* having the first circularity is caught by the edge of the cleaning blade 31, forming a wall between the edge and the transfer belt 44. The formed wall blocks the toner 53*a* of the second circularity coming after the toner 53*b* of the first circularity so as to prevent the toner 53*a* of the second circularity (higher circularity) from escaping from the edge of the cleaning blade 31. That is, in the image forming apparatus 1 according to the present embodiment, the developing device 43 discharges toner such that the toner 53*b* having the first circularity reaches the cleaning blade 31 in advance of the toner 53*a* having the second circularity, and the toner 53*a* having the second circularity reaches the cleaning blade 31 afterward. With such a configuration, the amount of toner 53 that escapes from the cleaning blade 31 decreases, thus improving the cleanability.

Note that in FIG. 1, one developing device 43 (first developing device 43) for toner having a lower circularity (first circularity) is preferably disposed downstream of another developing device 43 (second developing device) for toner having a higher circularity (second circularity) in the direction of conveyance of belt. Such an arrangement of the developing devices 43 allows the toner 53*b* having the first circularity to first reaches the cleaning blade 31 because with such an arrangement of the developing devices 43, the distance from the first developing device 43 for the toner 53*b* having the first circularity to the cleaning unit 32 is shortest among the distances from the developing devices 45 for the colors to the cleaning unit 32. Thus, with such a configuration, a period of time from a time when toner 53 exits the first developing device 43 disposed downstream in the direction of conveyance of belt to a time when the toner 53 arrives at the cleaning unit 32 is made shortest. As a result, starting up the image forming apparatus 1 is hastened. In such cases, the developing devices 43 for the respective colors may discharge toner 53 at the same time. By contrast, when the first developing device 43 to discharge the toner 53*b* having the first circularity is disposed upstream (for example, at the extreme upstream) in the direction of conveyance of belt, a second toner pattern 80 of the toner 53*a* discharged from the second developing device 43 disposed at the extreme downstream is formed after the first toner pattern 80 of toner 53*b* discharged from the first developing device 43 disposed upstream passes by the second developing device 43 disposed at the extreme downstream.

In some embodiment, irrespective of the procedure of the refresh process in FIG. 3, a toner pattern 80 of toner 53*b* having a lower circularity (the first circularity) is preferably formed between the transfer sheets on the transfer belt 44 so that the formed toner pattern 80 of the toner 53*b* having the first circularity is forced to reach the cleaning blade 31 during the image formation. Subsequently, toner 53 for the other colors having circularities different from the first circularity is subjected to the procedure of the refresh process in FIG. 3. When the average printing area ratio for toner 53 having a circularity is less than or equal to the threshold value (Yes for in step S17), the refresh process is performed for the toner 53. Causing toner 53*b* having the first circularity to first reach the cleaning blade 31 forms a wall of the toner 53*b* having the first circularity between the cleaning blade 31 and the transfer belt 44, thereby allowing a successful cleanability.

When the circularity is defined by a ratio of a perimeter of a circle having an area equal to a projected area of toner particles relative to a perimeter of a projected image, tone 53*a* having a higher circularity (second circularity) preferably has a circularity of greater than or equal to 0.96, and toner 53*b* having a lower circularity (first circularity) preferably has a circularity of less than 0.96. It is more difficult to remove toner 53*a* having a higher circularity by the cleaning blade 31. In order to deal with such a situation, a wall is formed by toner 53*b* having a lower circularity (of less than 0.98) in the edge of the cleaning blade 31 to block toner 53*a* having a circularity of greater than or equal to 0.98, thus achieving a successful cleanability. Even when toner 53*a* having a relatively high circularity ranging from 0.96 through 0.98 fails to be successfully removed by the cleaning blade 31, forming a wall by the toner 53*b* having a relatively low circularity to block the toner 53*a* having a relatively high circularity, thus securing a successful cleanability.

Next, a specific description is given of a method and process for discharging toner 53. For example, the following description is directed to a case in which yellow toner has a circularity of 0.96, magenta toner has a circularity of 0.97, cyan toner has a circularity of 0.98, and black toner has a circularity of 0.98.

In the present embodiment, toner 53 is discharged from the developing device 43 of the colors (yellow, magenta, cyan, and black) such that toner 53*b* having a lower circularity, such as yellow toner and magenta toner, first reaches the cleaning blade 31 and toner 53*a* having a higher circularity (highest circularity), such as cyan toner and black toner, subsequently reaches the cleaning blade 31. More specifically, toner 53 is discharged from the developing device 43 for yellow, magenta, cyan, and black such that formed toner patterns 80 for yellow, magenta, cyan, and black reaches the cleaning blade 31 in the recited order.

Thus, the CPU 55, which is a controlling device disposed in the apparatus body, controls the timing of forming a toner pattern 80 for each color such that toner 53*b* having a lower circularity, i.e., yellow toner and magenta toner reaches the cleaning blade 31 in order of yellow toner and magenta toner, and toner 53*a* having a higher circularity, i.e., cyan toner and black toner, subsequently enters the cleaning blade 31 in order of cyan toner and black toner. Firstly, toner patterns 80 are respectively formed of yellow toner and magenta toner, each of which has a lower circularity and is more likely to be caught the edge of the cleaning blade 31, and the formed toner patterns 80 are moved to and caught by the cleaning blade 31, thus forming a wall at the edge of the cleaning blade 31. Next, the developing devices 43 for cyan and black respectively discharge cyan toner and black toner, each of which has a higher circularity, to the respective the photoconductor drums 3 so that toner patterns 80 for cyan and black are formed on the transfer belt 44. The wall formed by yellow toner and magenta toner having a lower circularity at the edge of the cleaning blade 31 prevents cyan toner and black toner having a higher circularity from escaping from the cleaning blade 31. Such a configuration prevents the toner patterns 8 for the refresh process from escaping from the cleaning blade 31, thus preventing a cleaning failure.

A description is given of a method for measuring an average circularity of toner 53.

As a method for measuring the shape of toner 53, a method of optical detection range is appropriate in which suspension liquid including toner particles 51 passes through a detection range of an imaging unit on a flat plate and a charge-coupled device (CCD) optically detects and analyzes a particle image. The perimeter of a circle having an area equivalent to a projection area obtained by such a method is divided by a perimeter of an actual particle to obtain an average circularity of toner.

The obtained value (average circularity) is a value measured as an average circularity by a flow particle image analyzer FPIA-3000 manufactured by Malvern. As a specific measuring method, 0.1 ml to 5 ml of surfactant, preferably alkylbenzene sulfonate, as dispersant and 0.1 g to 0.5 g of measurement specimen are added to water ranging from 100 through 150 ml from which impure solid material is preliminarily eliminated in a vessel. The suspension liquid, in which the specimen is dispersed, is subjected to the distributed process by ab ultrasonic disperser for 1 through 3 minutes and the shape and distribution of toner are measured by the flow particle image analyzer with three thousand through ten thousand/μl as the concentration of the dispersant. As a result, the average circularity is obtained.

Thus obtained value of the average circularity of toner is stored in each of the NVRAM 61, 62, 63, and 64 mounted on the respective toner container. With each toner container mounted on the image forming apparatus 1, the CPU 55 recognizes the value of average circularity of toner 53 corresponding to the color of the mounted toner container.

As described above, the image forming apparatus 1 according the embodiments of the present disclosure controls the order of discharge of toner 53 according to the circularity of toner of each color during the refresh process. Specifically, during the refresh process, toner is discharged to the cleaning blade 31 such that toner 53*b* having a lower circularity among toner of the colors first reaches the cleaning blade 31 and toner 53*a* having a circularity higher than the toner, which has first reached the cleaning blade 31, subsequently reaches the cleaning blade 31 (alternatively, toner having the highest circularity reaches the cleaning blade 31 subsequently).

In the image forming apparatus, when a large amount of toner having a higher circularity first reaches the cleaning blade during the refresh process, a cleaning failure may occurs.

According to the embodiments of the present disclosure, toner having a higher circularity, which is discharged from the developing device during the refresh process, is effectively removed from the intermediate transferor.

In the image forming apparatus that employs toner of plural colors, such as yellow, magenta, cyan and black, the toner of each color has a different circularity. Accordingly, during the refresh process, toner having a lower circularity, which is more likely to be caught by a cleaning device, is primarily discharged to the cleaning device, thereby forming a wall in the cleaning device. Subsequently, toner having a higher circularity is discharged to the cleaning device, and the subsequently discharged toner is blocked by the wall formed by the toner having a lower circularity. With such a configuration, the toner having a higher circularity to be discharged during the refresh process is reliably removed from the intermediate transferor in the image forming apparatus that performs the refresh process.

Numerous additional modifications and variations are possible in light of the above teachings. It is therefore to be understood that within the scope of the appended claims, the present disclosure may be practiced otherwise than as specifically described herein. Such variations are not to be regarded as a departure from the scope of the present disclosure and appended claims, and all such modifications are intended to be included within the scope of the present disclosure and appended claims. The number, position, and shape of the components of the image forming apparatus described above are not limited to those described above.

What is claimed is:

1. An image forming apparatus comprising:

a plurality of image bearers to bear electrostatic latent images;

a plurality of developing devices disposed opposite the plurality of image bearers, to develop the electrostatic latent images borne on the plurality of image bearers into toner images of colors;

a plurality of first transfer devices to primarily transfer the toner images from the plurality of image bearers to an intermediate transferor with a primary transfer bias;

a second transfer device to secondarily transfer the toner images from the intermediate transferor to a recording medium with a secondary transfer bias;

a cleaning device to remove toner remaining on the intermediate transferor after a secondary transfer process; and a processor to control the plurality of developing devices to perform a refresh process to discharge toner from the plurality of developing devices to the plurality of image bearers, and wherein among toner of the colors, toner having a first circularity first reaches the cleaning device and toner having a second circularity higher than the first circularity subsequently reaches the cleaning device in the refresh process.

2. The image forming apparatus according to claim 1, wherein the processor performs the refresh process only when a printing area ratio of toner is less than or equal to a threshold value.

3. The image forming apparatus according to claim 2, wherein the threshold value of the printing area ratio is 3%.

4. The image forming apparatus according to claim 1, wherein when a printing area ratio of the toner having the first circularity is greater than or equal to a threshold value and a printing area ratio of the toner having the second circularity is less than or equal to the threshold value, the processor performs the refresh process for the toner having the first circularity and then performs the refresh process for the toner having the second circularity.

5. The image forming apparatus according to claim 1, further comprising a temperature sensor to detect a temperature in an interior of the image forming apparatus, wherein the processor determines not to perform the refresh process for the toner having the first circularity according to the detected temperature.

6. The image forming apparatus according to claim 1, wherein the processor performs the refresh mode at a low-speed mode.

7. The image forming apparatus according to claim 1, further comprising a control unit to input an instruction to perform the refresh process.

8. The image forming apparatus according to claim 1, further comprising a control unit to input an instruction to switch execution and non-execution of the refresh process.

9. The image forming apparatus according to claim 1, further comprising an external interface connectable to an external device, to receive an instruction to perform the refresh process from the external device.

10. The image forming apparatus according to claim 1, further comprising an external interface connectable to an external device, to receive an instruction to switch execution and non-execution of the refresh process from the external device.

11. The image forming apparatus according to claim 1, wherein a first developing device of the plurality of developing devices accommodating the toner having the first circularity is disposed downstream of a second developing device of the plurality of developing devices accommodating the toner having the second circularity in a direction of conveyance of the intermediate transferor.

12. The image forming apparatus according to claim 1, wherein the processor controls the plurality of developing devices to form a toner pattern of the toner having the first circularity between transfer sheets on the intermediate transferor in image formation.

13. The image forming apparatus according to claim 1, wherein when circularity is defined by a ratio of a perimeter of a circle having an area equal to a projected area of a toner particle relative to a perimeter of a projected image of the toner particle, the toner having the second circularity has a circularity of greater than or equal to 0.96 and the toner having the first circularity has a circularity of less than 0.96.

* * * * *